US008733446B2

(12) United States Patent
Espinasse et al.

(10) Patent No.: US 8,733,446 B2
(45) Date of Patent: May 27, 2014

(54) FLEXIBLE RISER PIPE INSTALLATION FOR CONVEYING HYDROCARBONS

(75) Inventors: Philippe Espinasse, Bihorel (FR); Alain Coutarel, Mont Saint-Aignan (FR); Isabel Teresa Waclawek, Touffreville la Corbeline (FR)

(73) Assignee: Technip France (FR)

( * ) Notice: Subject to any disclaimer, the term of this patent is extended or adjusted under 35 U.S.C. 154(b) by 738 days.

(21) Appl. No.: 12/524,045

(22) PCT Filed: Jan. 23, 2008

(86) PCT No.: PCT/FR2008/000079

§ 371 (c)(1),
(2), (4) Date: Sep. 23, 2009

(87) PCT Pub. No.: WO2008/107559

PCT Pub. Date: Sep. 12, 2008

(65) Prior Publication Data

US 2010/0018717 A1 Jan. 28, 2010

(30) Foreign Application Priority Data

Jan. 26, 2007 (FR) ..... 07 00549

(51) Int. Cl.
*E21B 43/013* (2006.01)
*F16L 1/12* (2006.01)

(52) U.S. Cl.
USPC ..... 166/350; 166/367; 166/345; 166/344; 405/224.2

(58) Field of Classification Search
USPC ..... 166/343, 344, 345, 359, 367, 166/77.1–77.3, 350; 405/224.2–4
See application file for complete search history.

(56) References Cited

U.S. PATENT DOCUMENTS 4,462,717 A 7/1984 Falcimaigne
6,053,213 A * 4/2000 Jung et al. ..... 138/130

(Continued)

FOREIGN PATENT DOCUMENTS

EP 0 937 933 A1 8/1999
FR 2 507 672 12/1982

(Continued)

OTHER PUBLICATIONS

International Search Report dated Jan. 15, 2009, issued in corresponding international application No. PCT/FR2008/000079.

(Continued)

*Primary Examiner* — James Sayre
(74) *Attorney, Agent, or Firm* — Ostrolenk Faber LLP

(57) ABSTRACT

The invention relates to a riser pipe installation that comprises a flexible duct of the non-bound type, the duct being vertically arranged between a mechanical connection with a submerged buoy at the stub on the one hand, and a mechanical connection with the seabed at the bottom on the other hand, wherein fluid connections are provided at the stub and at the bottom for connecting the riser pipe with surface equipment on the one hand and bottom equipment on the other hand; the bottom of the pipe is located at a depth of at least 1000 m where it is submitted to a computable maximum reverse bottom effect F, while the buoy is oversized in order to generate at the bottom of the riser pipe a reaction tension T higher than at least 50% or even 100% of the computable maximum reverse bottom effect F applied at the bottom of the pipe.

18 Claims, 14 Drawing Sheets

(56) References Cited

U.S. PATENT DOCUMENTS

| | | | | |
|---|---|---|---|---|
| 6,321,844 | B1 * | 11/2001 | Thiebaud et al. | 166/345 |
| 2008/0056826 | A1 | 3/2008 | Luppi | |

FOREIGN PATENT DOCUMENTS

| | | | |
|---|---|---|---|
| FR | 2 809 136 | | 11/2001 |
| FR | 2 876 142 | | 4/2006 |
| GB | 2 145 135 | A | 3/1985 |
| GB | 2 346 188 | A | 8/2000 |
| WO | WO 98/25063 | | 6/1998 |
| WO | WO 00/49267 | | 8/2000 |
| WO | WO 01/14687 | A | 3/2001 |
| WO | WO 02/053869 | | 7/2002 |
| WO | WO 02/063128 | | 8/2002 |
| WO | WO 02/066786 | | 8/2002 |
| WO | WO 03/083343 | | 10/2003 |
| WO | WO 2006/042939 | | 4/2006 |
| WO | WO 02/103153 | | 12/2007 |

OTHER PUBLICATIONS

Steve Hatton et al., "Third Generation Deepwater Hybird Risers," Presented at World Wide Deepwater Technologies, IBC, London, Jun. 1999, 7.

* cited by examiner

FLEXIBLE RISER PIPE INSTALLATION FOR CONVEYING HYDROCARBONS

CROSS REFERENCE TO RELATED APPLICATION

The present application is a 35 U.S.C. §§371 national phase conversion of PCT/FR2008/000079, filed Jan. 23, 2008, which claims priority of French Application No. 0700549, filed Jan. 26, 2007, the disclosure of which is incorporated by reference herein. The PCT International Application was published in the French language.

BACKGROUND OF THE INVENTION

The present invention relates to a flexible riser installation for conveying hydrocarbons or other fluids under pressure and to a method of creating such an installation.

Flexible pipes for conveying hydrocarbons, as opposed to rigid pipes, are already well known and generally comprise, from the inside of the pipe outward, a metal carcass, to react the radial crushing forces, covered by an internal sealing sheath made of polymer, a pressure vault to withstand the internal pressure of the hydrocarbon, tensile armor layers to react axial tensile forces and a polymer external sheath to protect the entire pipe and in particular to prevent seawater from penetrating its thickness. The metal carcass and the pressure vault are made up of longitudinal elements wound with a short pitch, and give the pipe its ability to withstand radial force while the tensile armor layers consist of generally metal wires wound at long pitches in order to resist axial forces. It should be noted that in the present application, the idea of winding at a short pitch denotes any helical winding at a helix angle close to 90°, typically comprised between 75° and 90°. The idea of winding at a long pitch for its part covers helix angles of below 55°, typically comprised between 25° and 55° for the tensile armor layers.

These pipes are intended to convey hydrocarbons, particularly on the seabed, and to do so at deep depths. More specifically, they are said to be of the unbonded type and are thus described in the standards published by the American Petroleum Institute (API), API 17J and API RP 17B.

When a pipe, regardless of its structure, is subjected to an external pressure that is higher than the internal pressure, compressive forces directed parallel to the axis of the pipe and which tend to shorten the length of the pipe occur in the pipe wall. This phenomenon bears the name of reverse end cap effect. The intensity of the axial compressive forces is substantially proportional to the difference between the external pressure and the internal pressure. This intensity may reach very high levels in the case of a flexible pipe submerged at a great depth, because the internal pressure can, under certain conditions, be very much lower than the hydrostatic pressure.

In the case of a flexible pipe of conventional structure, for example one in accordance with the API standards, the reverse end cap effect has a tendency of introducing a longitudinal compressive force into the wires that make up the tensile armor layers, and to shorten the length of the flexible pipe. In addition, the flexible pipe is also subjected to dynamic bending stresses, particularly when it is being installed or when it is in service in the case of a riser, that is to say a pipe that makes the connection between a service installation at sea level or thereabouts, and an installation at the bottom of the sea. All of these stresses may cause the wires of the tensile armor layer to buckle and may irreversibly disorganize the tensile armor layers, thus destroying the flexible pipe.

Structural improvements to flexible pipes in order to increase the axial compressive strength of the armor layers have therefore been sought.

Thus, document WO 03/083343 describes such a solution which consists in winding around the tensile armor layers reinforced tapes, for example made with aramid fibers. This then limits and controls the expansion of the tensile armor layers. However, while this solution does solve the problems associated with the radial buckling of the wires that make up the tensile armor layers, it is capable only of limiting the risk of lateral buckling of said wires, which still remains.

Document WO 2006/042939 describes a solution which consists in using wires that have a high width-to-thickness ratio and in reducing the total number of wires that make up each tensile armor layer. However, while this solution reduces the risk of lateral buckling of the tensile armor layers, it does not completely eliminate it.

Application FR 06 07421 in the name of the Assignee hereof discloses a solution that involves adding to the inside of the structure of the flexible pipe a tubular axial-blocking layer. This layer is designed to react the axial compressive forces and to limit the shortening of the pipe, making it possible to avoid damaging the tensile armor layers.

These solutions are effective but have a certain number of constraints, particularly financial ones, which have led to a desire for alternative solutions, at least for specific cases, particularly for the specific case of risers.

There are various different configurations of flexible riser. The most widespread configurations are depicted in FIG. 4 of the standard "API RP 17B; Recommended Practice for Flexible Pipes; Third Edition; March 2002". These are known to those skilled in the art by the names of "Free Hanging", "Steep S", "Lazy S", "Steep Wave" and "Lazy Wave". Another configuration, known by the name of "Pliant Wave®" is described in U.S. Pat. No. 4,906,137.

In the "Steep S", "Lazy S", "Steep Wave", "Lazy Wave" and "Pliant Wave®" configurations, the flexible riser is supported, at a depth somewhere between the bottom and the surface, by one or more positive-buoyancy members, of the underwater buoy or arch type. This gives the flexible riser an S-shaped or wave-shaped geometry, allowing it to tolerate the vertical movements of the surface installation without introducing excessive curvature into said pipe, particularly in the region situated near to the seabed, as such excessive curvature is liable incidentally to damage said pipe. These configurations are generally reserved for dynamic applications at a depth of less than 500 m.

In the "Free Hanging" configuration the flexible riser is arranged as a catenary between the seabed and the surface installation. This configuration has the advantage of simplicity but the disadvantage of being ill-suited to dynamic applications at small depths because of the excessive variations in curvature that may be generated near the seabed. However, this configuration is commonly used for very deep applications, that is to say applications at depths in excess of 1000 m, or even 1500 m. This is because under such conditions, the relative amplitude of the movements of the floating support, particularly the vertical movements associated with the swell, remains very much smaller than the length of the catenary, thus limiting the amplitude of the variations in curvature near the seabed and making it possible to keep control over the risk of pipe fatigue and of lateral buckling of the tensile armor layers. However, in order to guarantee that the flexible pipe is able to withstand the reverse end cap effect, which at great depths may reach very high levels, the structure of the pipe has to be engineered according to the aforementioned known techniques, thus leading to solutions that are complex and expensive.

Also known are hybrid risers that use both rigid pipes and flexible pipes. Thus, documents FR 2 507 672, FR 2 809 136, FR 2 876 142, GB 2 346 188, WO 00/49267, WO 02/053869, WO 02/063128, WO 02/066786 and WO 02/103153 disclose a riser of the hybrid tower type. One or more rigid pipes rise up along a substantially vertical tower from the seabed up to a depth close to the surface, above which depth one or more flexible pipes provide the connection between the top of the tower and the floating support. The tower is equipped with buoyancy means to ensure that it remains in a vertical position. These hybrid towers are chiefly used for applications at very great depths. They have the disadvantage of being difficult to install. In particular, installing the rigid portion at sea generally requires very powerful lifting gear.

However, hitherto, no riser installation made as a flexible pipe standing vertically and able effectively to withstand the reverse end cap effect in uses in deep seas (that is to say typically at depths in excess of 1000 m, or even 1500 or 2000 m) without recourse to expensive structural modifications to the pipe was known. At such great depths, the end cap effect has a very large amplitude because of the magnitude of the hydrostatic pressure. When, in an installation for conveying hydrocarbons, particularly in gaseous form, production is halted, for example by closing a valve, the internal pressure inside the pipe may drop and the difference between the high external hydrostatic pressure and the low or zero internal pressure may become considerable. It is conditions such as these that give rise to the reverse end cap effect. If it is desired that a flexible pipe be used in a conventional riser installation, then it is obligatory to adapt the structure of the pipe so that it can withstand the reverse end cap effect at the foot of the riser, which means engineering the pipe reinforcing layers accordingly, the foot of the riser being the determining part, which leads to the remainder of the pipe being overengineered and therefore leads to additional cost.

SUMMARY OF THE INVENTION

It is an object of the invention to propose such a flexible riser installation that is effectively able to withstand the reverse end cap effect in spite of the great depth but which does not require penalizing structural modifications. Another object of the invention is to propose a method for installing this pipe at sea.

The invention achieves its objective by virtue of a riser installation produced using a flexible pipe of the unbonded type, said pipe comprising, from the inside outwards, at least one internal sealing sheath and at least two layers of tensile armor wires wound with a long pitch, the pipe being arranged vertically between, on the one hand, a head mechanical connection with a submerged buoy and, on the other hand, a foot mechanical connection with the seabed, fluidic connections being provided at the head and at the foot to connect the riser, on the one hand, with surface equipment and, on the other hand, with seabed equipment, characterized in that the foot of the riser is at a depth of at least 1000 m where it experiences a calculatable maximum reverse end-cap effect F, and in that the buoy is engineered to apply to the foot of the riser a reaction tension T greater than at least 50% of the calculatable maximum reverse end-cap effect F developed at the foot of the riser.

What an internal sealing sheath means is the first layer, starting from the inside of the pipe, the function of which is to provide sealing against the fluid flowing through the pipe. In general, the internal sealing sheath is an extruded polymer tube. However, the present invention applies equally well to instances in which said internal sealing sheath consists of an impervious and flexible metal tube, of the kind disclosed in document WO 98/25063.

In this application, the reverse end cap effect is given by the formula F=(Pext×Sext)−(Pint×Sint).

Pext is the external hydrostatic pressure outside the pipe, in the region near the seabed. Pint is the minimum internal pressure inside the pipe, in the region near the seabed. This is the lowest internal pressure seen by the pipe throughout its service life, in the region near the seabed. This minimum pressure is generally evaluated right from the pipe design phase, because it governs the engineering of the pipe. Sint is the internal cross sectional area of the internal sealing sheath to which the internal pressure is directly applied. Sext is the external cross section of the sealing sheath to which the external pressure is directly applied.

In the case of a flexible pipe that has just one sealing sheath, namely the internal sealing sheath, Sext is equal to the external cross section of this sheath. This is because the hydrostatic pressure in this case is applied directly to the external face of the internal sealing sheath. Flexible pipes that have this feature are described notably in documents WO 02/31394 and WO 2005/04030. Such pipes may comprise a non-sealing external polymer sheath which, because it does not seal, plays no part in calculating F.

In general, the flexible pipe comprises at least two sealing sheaths, namely, on the one hand, an internal sealing sheath to the internal face of which the internal pressure is directly applied and, on the other hand, another sealing sheath surrounding said internal sealing sheath and to the external face of which the external pressure is directly applied.

Often, this other sealing sheath directly subjected to the hydrostatic pressure is the outermost layer of the flexible pipe, in which case it is known by the name of external sealing sheath. In this case, Sext is equal to the external cross section of this external sealing sheath.

However, there are also flexible pipes, particularly smooth bore pipes, in which this other sealing sheath directly subjected to the hydrostatic pressure is an intermediate sealing sheath generally situated between the pressure vault and the internal layer of tensile armor wires. In this case, Sext is equal to the external cross section of this intermediate sealing sheath which is directly subjected to the hydrostatic pressure.

By way of example, if we consider a rough bore pipe made up, starting from the inside and working outward, of a metal carcass, a polymer internal sealing sheath of internal diameter Dint, a pressure vault, a pair of tensile armor wires and a polymer external sealing sheath of external diameter Dext, the calculatable maximum reverse end cap effect F is given by the formula:

$$F=(P\text{ext}\times\pi D^2\text{ext}/4)-(P\text{int}\times\pi D^2\text{int}/4)$$

Thanks to a riser foot tension T very much greater than simply supporting the flexible riser would justify, it is possible at least partially to compensate the reverse end cap effect and avoid causing the tensile armor layers to work too much in compression, thus making it possible to simplify the structure of the pipe and therefore reduce its cost. In addition, it is thus possible to increase the water depth accessible without having to resort to major modifications to the known techniques for designing and manufacturing the flexible pipes. The invention thus makes it possible to get around the use of a tubular axial-blocking layer of the kind described in application FR 06 07421. It also makes it possible to dispense with or reduce the thickness of the anti-expansion layer or layers, which layers are described in particular in document WO 03/083343, and the function of which is to limit the expansion of the tensile armor layers when these are subjected to compressive force. These anti-expansion layers are generally made up of reinforced Kevlar® tapes wound around the tensile armor layers. Because of the high cost of the Kevlar®, reducing or eliminating these tapes allows a significant saving to be made. Another advantage of the invention is that it reduces the risk of lateral buckling of the tensile armor, and that it therefore increases the depth at which the flexible pipes can be used as risers. This also makes it possible to avoid the use of tensile armor wires with high width-to-thickness ratios, thus making the pipes easier to manufacture.

The present invention advantageously applies to any flexible pipe of the unbonded type provided that it comprises at least one internal sealing sheath and one pair of tensile armor wires.

Advantageously, the buoy is engineered to apply to the riser a tension T greater than at least 75% of the maximum reverse end-cap effect F developed at the foot of the riser, and more advantageously still, the buoy is engineered to apply to the riser a tension T greater than at least 100% of the maxium reverse end-cap effect F developed at the foot of the riser. In the latter instance, it is possible to ensure that the tensile armor will never be placed in compression by the reverse end cap effect and it is therefore particularly advantageous to choose to produce the flexible pipe using tensile armor wires based on carbon fiber. Such tensile armor layers offer the advantage of lightness of weight but are not very good at resisting compression. The invention allows them to be used for a riser through the intermediary of these precautions of high tension imposed by the buoy at the head of the riser.

Such high-buoyancy buoys do not present any particular problem with feasibility insofar as they are already used in the aforementioned field of hybrid towers. The aforementioned documents relating to these hybrid towers in particular describe buoys that could be used for the present invention.

The head fluidic connection generally comprises a head connecting flexible pipe connecting the top of the riser to the surface equipment, via appropriate accessories and end fittings.

An installation according to the invention also advantageously has one or more of the following features:

the internal sealing sheath of the flexible riser is a polymer sheath.

The flexible riser comprises a polymer external sealing sheath surrounding the layers of tensile armor wires.

The hydrostatic pressure is applied directly to the external face of the internal sealing sheath The flexible riser comprises, between the internal sealing sheath and the layers of tensile armor wires, an internal pressure vault produced by a short-pitch helical winding of wire, which is intended to withstand the internal pressure of the fluid being conveyed.

The layers of tensile armor wires of the flexible riser comprise layers of wires based on carbon fiber.

The foot mechanical connection comprises at least one anchor cable tethering the bottom of the flexible riser to an anchor point fixed on the seabed. This anchor cable may be replaced by any equivalent connecting means that has both good mechanical tensile strength and good flexibility in bending, such as a chain or an articulated mechanical device for example.

The foot fluidic connection comprises a foot connection flexible pipe connecting the bottom of the riser to a production pipe, via appropriate accessories and end fittings.

The foot fluidic connection is via a connecting lower end fitting fixed at the bottom of the flexible riser, and the above-mentioned at least one anchor cable is secured at its upper end to said lower connecting end fitting.

Said foot connecting flexible pipe has distributed buoyancy.

The buoy has a central bore for the passage of the flexible riser, the diameter of the bore being greater than that of a connecting upper end fitting of said flexible riser.

The head mechanical connection comprises a multi-part collar that serves as an end stop between the upper part of the buoy and the connecting upper end fitting of the flexible riser.

A bend limiter is provided at the bottom of the bore through the buoy.

The head mechanical connection comprises a tension line connecting the bottom of the buoy to an element secured to the top of the flexible riser.

The element secured to the top of the flexible riser is a gooseneck used for the head fluidic connection.

The invention also relates to a method of installing the installation according to the invention.

This then is a method of installing a riser installation produced using a flexible pipe of the unbonded type, said pipe comprising, from the inside outwards, at least one internal sealing sheath and at least two layers of tensile armor wires wound with a long pitch, the pipe being arranged vertically between, on the one hand, a head mechanical connection with a submerged buoy and, on the other hand, a foot mechanical connection with the seabed, fluidic connections needing to be provided at the head and at the foot to connect the riser, on the one hand, with surface equipment and, on the other hand, with seabed equipment, the method being characterized in that the foot of the riser is positioned at a depth of at least 1000 m where it experiences a calculatable maximum reverse end-cap effect F, and in that the buoy is engineered to apply to the foot of the riser a reaction tension T greater than at least 50% of the calculatable maximum reverse end-cap effect F developed at the foot of the riser.

Advantageously, in order to lay the installation, use is made of a first vessel from which the flexible pipe is paid out and of a second vessel for supporting the buoy and which is capable of supporting the ballasted buoy between a raised position close to the surface and a lowered position close to the seabed; a first end of the paid-out flexible pipe is attached to the buoy in the raised position; the flexible pipe is paid out in such a way that it hangs between the first vessel and the second vessel; a second end of the paid-out flexible pipe is extended by a connecting hose fitting with a fluidic coupling; an attachment line is used to attach said coupling to the first laying vessel, and this attachment line is paid out in order to lower said coupling substantially to said second end; said coupling and said second end are lowered down near to the seabed; said second end is mechanically connected and said coupling is fluidically connected, and the buoy then has its ballast removed.

Advantageously, the flexible pipe is filled with water during laying.

BRIEF DESCRIPTION OF THE DRAWINGS

Other particulars and advantages of the invention will emerge from reading the description given hereinafter, by way of nonlimiting indication, with reference to the attached drawings in which.

DESCRIPTION OF A PREFERRED EMBODIMENT

Figure 1:
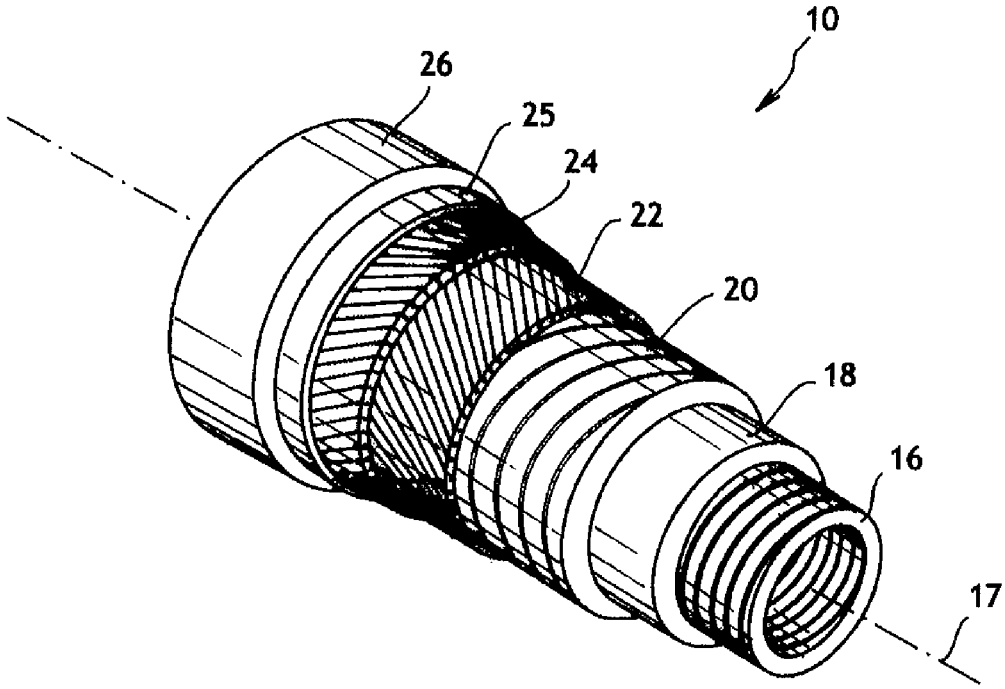
FIG. 1 is a partial perspective schematic view of a flexible pipe that can be used according to the invention.

FIG. 1 illustrates an unbonded flexible pipe 10 of the rough bore type and which here, from the inside of the pipe outward, has an internal metal rough bore 16, an internal sealing sheath 18 made of plastic, an interlocked pressure vault 20, two crossed tensile armor layers 22, 24, an anti-expansion layer 25 produced by winding woven Kevlar® fiber tapes, and an external sealing sheath 26. The flexible pipe 10 thus runs longitudinally along the axis 17. The metal rough bore 16, the interlocked pressure vault 20 and the anti-expansion layers 25 are produced from longitudinal elements helically wound with a short pitch, while the crossed armor layers 22, 24 are formed of helical windings of armor wires with a long pitch.

In another type of pipe known as a smooth bore pipe, the rough bore 16 is eliminated and an intermediate sealing sheath is generally added between, on the one hand, the pressure vault 20 and, on the other hand, the inner armor layer 22.

Figure 2:
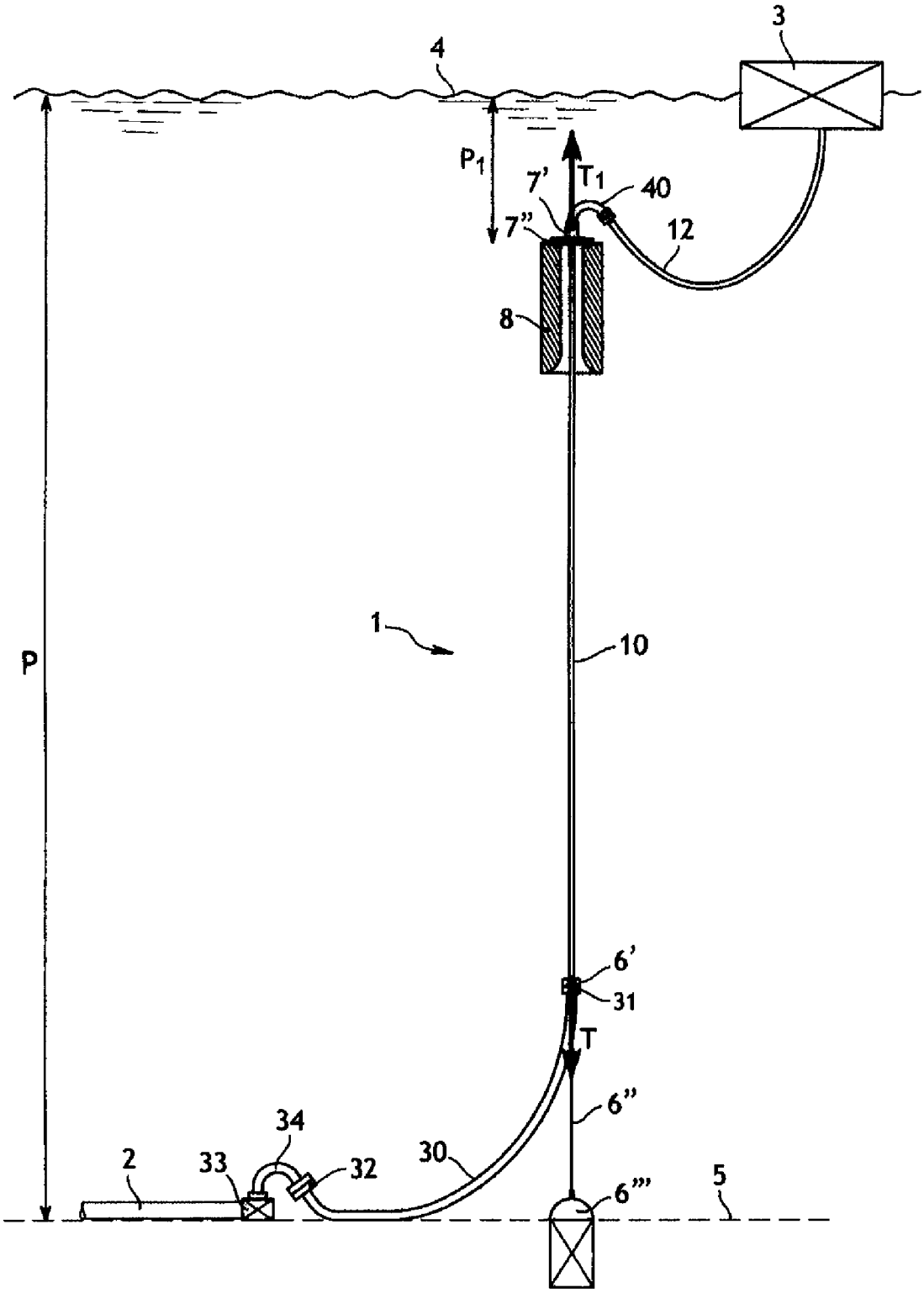
FIG. 2 is a schematic view in elevation of a riser installation according to the invention.

FIG. 2 schematically depicts the riser 1 of the invention intended to raise a fluid, in theory a liquid or gaseous or biphasic hydrocarbon, between a production installation 2 situated on the seabed 5 and an operating installation 3 floating at the surface 4 of the sea. The production installation 2 depicted in FIG. 2 is a pipe, generally a rigid pipe, resting on the seabed and generally known to those skilled in the art by the name of a "flow line". This pipe provides the connection between, on the one hand, the foot of the riser 1 and, on the other hand, an underwater installation of the manifold or well head type.

The riser is essentially made up of a flexible riser pipe portion 10 stretched between a mechanical connection 6', 6", 6'" that attaches it to the seabed 5 at the foot of the riser and a mechanical connection 7', 7" that attaches it to a submerged buoy 8 at the head of the riser. The attachment means 7', 7" have the function of transmitting to the upper part of the flexible pipe the positive buoyancy force generated by the buoy 8. The mechanical attachment means 6', 6", 6'" have the function of tethering the base of the flexible pipe 10 to the seabed 5.

Head connection means 40, 12 extend the flexible riser 10 from its upper end and allow the conveyed fluid to circulate toward the operating installation 3. Foot connection means 33, 34, 30 ensure the continuity of flow of the conveyed fluid between, on the one hand, the underwater production installation 2 and, on the other hand, the lower part of the flexible riser 10.

In a typical installation envisioned by the Applicant Company, the depth P of the sea is greater than 1000 m and may for example be as much as 3000 m. The buoy 8 is submerged at a height P1 below sea level, which is typically comprised between 100 m and 300 m in order to escape from surface marine currents. At the head of the riser the buoy applies thereto a tension T1 directed upward. This tension T1 is defined by the buoyancy of the buoy 8. Bearing in mind the apparent weight of the underwater pipe, the reaction force T applied to the foot of the riser at the attachment 6' has, as its intensity, the difference between the tension T1 at the head and the apparent relative weight of the riser.

According to the present invention, the buoyancy of the buoy is defined in such a way that the resultant tension T applied to the lower part of the flexible riser is high enough to compensate for at least 50%, advantageously 75% and preferably 100% of the axial compressive force generated by the reverse end cap effect.

One of the important features of the invention is the very high buoyancy imposed on the buoy 8. According to the chosen embodiment, the difference between the buoyancy strictly needed to maintain the assembly and the buoyancy suitable for implementing the present invention may exceed 70 000 daN, perhaps 100 000 daN or even 200 000 daN, which is a very high value markedly higher than the margins of safety, which are of the order of 10 000 daN to 20 000 daN, which would previously have seemed sufficient to those skilled in the art. This substantial overengineering of the buoy results in a significant additional cost of the buoy, which means that in the past, this had been avoided. The present invention adopts the opposite approach. By increasing the size and cost of the buoy it is possible, contrary to all expectations, to make an even greater saving in the structure of the flexible riser 10, this advantage largely compensating for the disadvantage associated with the additional cost of the buoy 8.

The example that follows illustrates this point. Let us consider a flexible riser 10 for conveying gas, with an internal diameter of 225 mm and an external diameter of 335 mm, and running between a seabed situated at a depth P=2000 m and the buoy 8 situated at a depth P1=200 m. Let us also assume that, in the event of a halt in production, the pressure inside the pipe can drop to 1 bar, in the region near the seabed, this internal pressure moreover being the minimum pressure intended throughout the life and operation of the pipe. The hydrostatic pressure at the foot of the pipe is substantially equal to 200 bar. Hence, in this example:

Pext=200 bar=2 daN/mm$^2$

Pint=1 bar=0.01 daN/mm$^2$

Dext=335 mm

Dint=225 mm which means that the maximum reverse end cap effect is:

$$F=(2\times\pi\times335^2/4)-(0.01\times\pi\times225^2/4)\approx176\ 000\ \text{daN}$$

According to earlier practice, the tension T introduced at the foot of the riser was low, of the order of 15 000 daN, which meant that the pipe had then to be engineered to withstand a reverse end cap effect of the order of 180 000 daN. In practice, in this example, this would have led to the choice of a structure that had two tensile armor layers 22, 24 made of steel, each 4 mm thick, and a thick Kevlar® anti-expansion layer 25. The steel wires that made up the tensile armor layer would in addition have had to have a high width-to-thickness ratio, typically 20 mm by 4 mm, in order to prevent lateral buckling of the tensile armor layers. The in-water weight of such a pipe, when full of gas, would then have been of the order of 100 daN per linear meter, which would have led to a total weight of 180 000 daN. The buoy supports not only the in-water apparent weight of the pipe 10, but also that of some of the foot connection means 30 and together with substantially half the weight of the head connection means 40, 12, the other half being supported by the operating installation 3. In this example, these additional weights that have to be supported are of the order of 20 000 daN. As a result, according to the earlier practice, the buoy would have been engineered to have a buoyancy capable of generating, at the head of the riser, a tension:

$$T1=180\,000+20\,000+15\,000=215\,000 \text{ daN}.$$

According to a first embodiment of the invention, the tension T at the foot of the riser is equal to 50% of F, that is to say to 88 000 daN. The flexible pipe 10 in this case has to be engineered to withstand an axial compressive force of the order of 90 000 daN rather than the aforementioned 180 000 daN according to the prior art. This substantial reduction in axial compression makes it possible in this example to choose a structure comprising two tensile armor layers 22, 24 made of steel each 3 mm thick and made up of conventional wires that do not have a high width-to-thickness ratio. The thickness of the anti-expansion Kevlar® layer 25 in this instance is practically half that according to the aforementioned prior art. The in-water weight of such a pipe, when full of gas, is of the order of 90 daN per linear meter, that is to say appreciably lower than that of a pipe according to the aforementioned prior art. The total in-water weight of the pipe 10 is therefore around 162 000 daN. As a result, according to this embodiment of the invention, the buoy has to engineered to have a flexibility able to generate at the head of the riser a tension:

$$T1=162\,000+20\,000+T=162\,000+20\,000+88\,000=252\,000 \text{ daN}$$

According to this embodiment of the invention, the buoyancy of the buoy 8 has, in this example, therefore been increased by 37 000 daN in terms of absolute value, or by 17% in terms of relative value by comparison with the earlier practice. This disadvantage is compensated for by the savings made in the structure of the pipe.

According to a particularly advantageous second embodiment of the invention, the tension T at the foot of the riser is equal to F, that is to say to 176 000 daN.

In this case, insofar as the reverse end cap effect F is completely compensated for and insofar as it is possible to avoid placing the tensile armor layers 22, 24 in compression, it is possible and advantageous to choose for these tensile armor layers wires made of a composite material, preferably based on carbon fiber. Reference may, for example, be made to document U.S. Pat. No. 6,620,471 in the name of the Assignee Company, which discloses composite tapes comprising composite fibers embedded in a thermoplastic matrix. Such reinforcing armor affords good tensile strength and leads to a lighter weight flexible pipe than metal armor. By contrast, as they have poor compressive strength, they can be used only under conditions in which the risk of being placed in compression is averted, which it is with the invention that allows the armor always to be kept under tension.

The use of carbon fiber tensile armor in place of steel armor makes it possible not only to lighten the weight of the pipe, which makes it easier to handle and to install at sea, but also to improve its corrosion resistance and avoid the hydrogen embrittlement phenomena encountered with steels which have good mechanical properties. The lack of axial compression also makes it possible to dispense with the Kevlar® anti-expansion layer 25, allowing a significant saving. The in-water weight of such a pipe, when full of gas, is, in this example, of the order of 60 daN per linear meter, which represents a 40% weight saving over the aforementioned prior art. The total in-water weight of the pipe 10 is therefore close to 108 000 daN. As a result, according to this embodiment of the invention, the buoy has to be engineered to have buoyancy capable of generating, at the head of the riser, a tension:

$$T=108\,000+20\,000+T=108\,000+20\,000+176\,000=304\,000 \text{ daN}.$$

The buoyancy of the buoy has therefore been increased by 89 000 daN in terms of absolute value or by 41% in terms of relative value compared with earlier practice. This disadvantage is largely compensated for by the savings made in the structure of the pipe and the ease of installation at sea, because of the lower weight of the pipe.

The embodiment of some of the equipments of the installation according to the invention will now be described in greater detail.

FIGS. 2 to 6 depict various means of connection at the foot. These means comprise a foot connecting pipe 30, generally of short length, in practice under 100 m long. This foot connecting pipe has to be engineered to withstand all of the reverse end cap effect. This foot connecting pipe may comprise one or more rigid or flexible pipe sections, possibly combined with one another. It may also comprise a mechanical device of the flexible joint type, the function of which device is to ensure the continuity of the flow while at the same time allowing degrees of freedom in bending similar to those of a flexible pipe.

Figure 6:
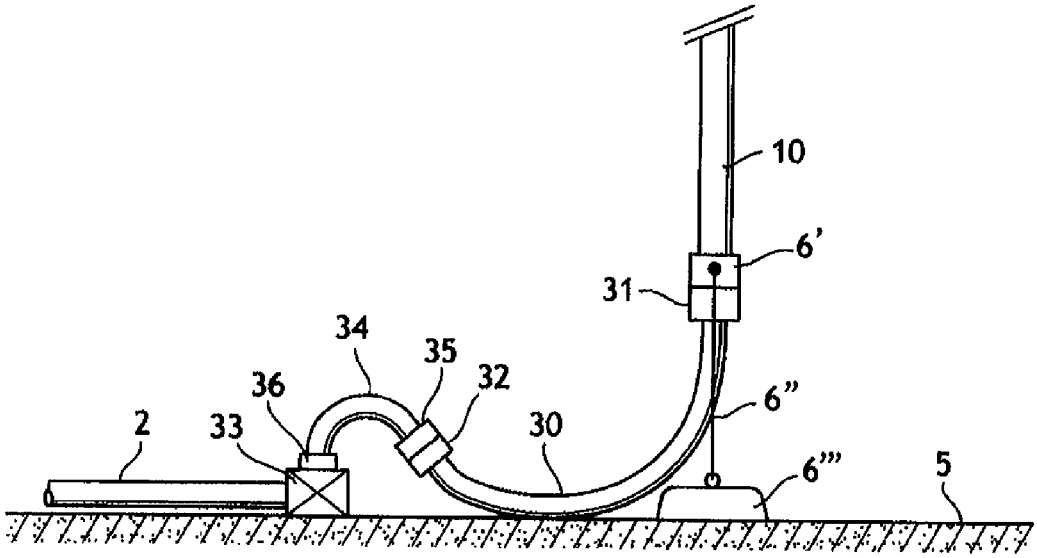
FIG. 6 is a partial schematic view of a third method of connection at the foot of a riser, also depicted in FIG. 2.

Advantageously, the foot connecting pipe 30 is a flexible pipe reinforced according to the aforementioned techniques of the prior art so that it can withstand the reverse end cap effect and in order to eliminate the risk of lateral buckling of the tensile armor layers. The structure of this foot connecting flexible pipe 30 generally differs greatly from that of the flexible riser 10. In FIG. 2 and FIG. 6, the flexible pipe 30 is connected at its lower end by an end fitting 32 to the end fitting 35 of a rigid spool piece 34 that allows a connection at the top with a vertical connector 33 placed at the end of the production pipe ("flow line") 2 and collaborating with a suitable end fitting 36 of the spool piece 34. The upper end of the hose 30 comprises an end fitting 31 connected to the lower end fitting 6' of the flexible pipe 10, which fitting is fixed to an anchor point 6' by a cable 6". The anchor point 6'" is secured to the seabed 5. It is engineered to withstand a pull-out tension greater than the tension T exerted by the foot of the riser. The anchor point 6'" is advantageously a suction anchor or gravity anchor piling.

Figure 3:
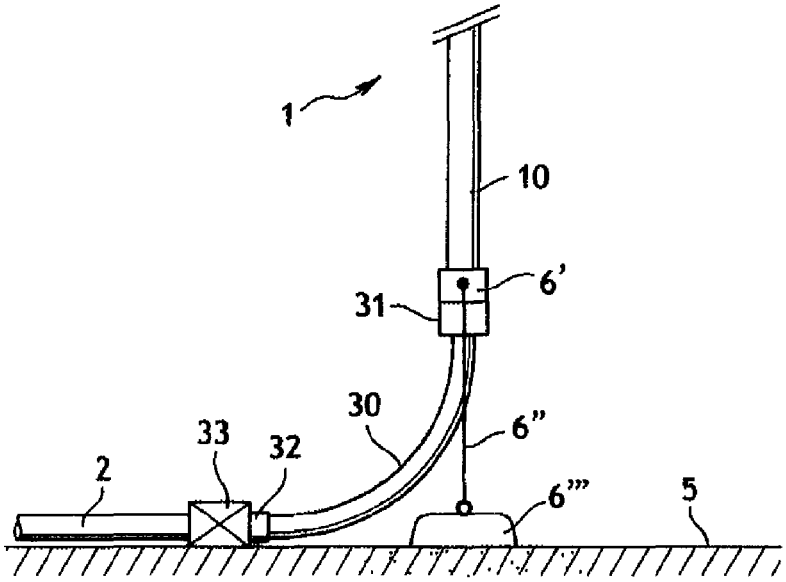
FIG. 3 is a partial schematic view of a first method of connection at the foot of a riser.
Figure 4:
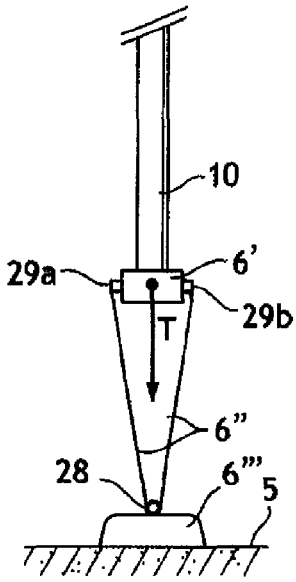
FIG. 4 is a side view of FIG. 3.

FIG. 3 shows an alternative form of horizontal connection of the pipe 30 directly in a horizontal connector 33 that terminates the production pipe 2. FIG. 4 shows that the lower end fitting 6' is in fact held by two cables 6" fixed to their upper end on two of its sides, and at their lower end to an articulated attachment 28 of the anchor point 6'".

Figure 5:
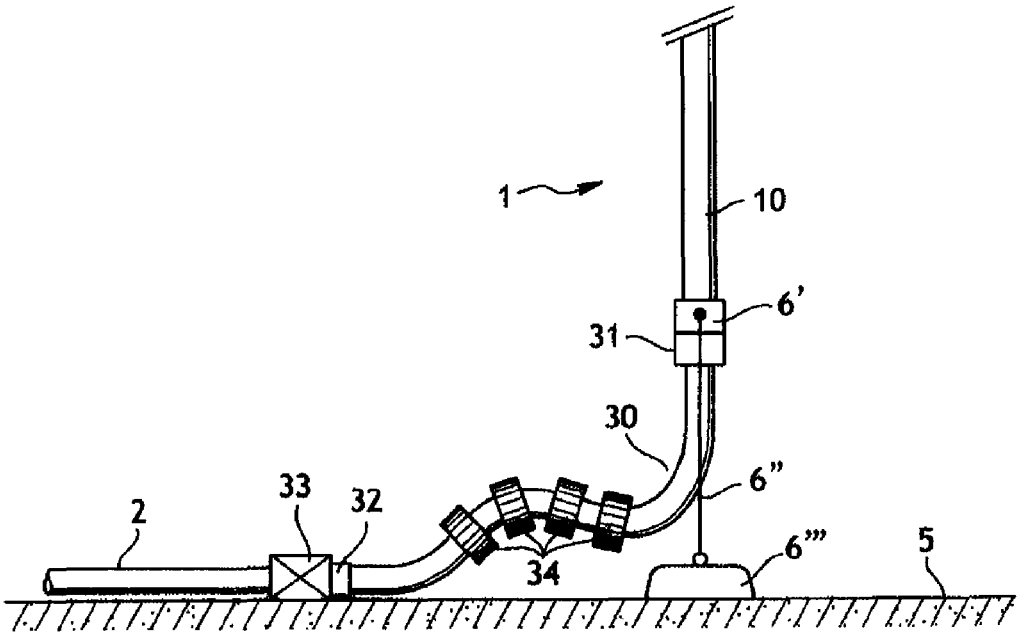
FIG. 5 is a partial schematic view of a second method of connection at the foot of a riser.

FIG. 5 shows an alternative form using a foot connecting flexible pipe 30 whereby the flexible pipe 30 has distributed buoyancy, by virtue of buoys 34 surrounding the pipe; this has the advantage that a large amount of angular excursion of the pipe 10 on either side of the vertical position can be tolerated.

Figure 7:
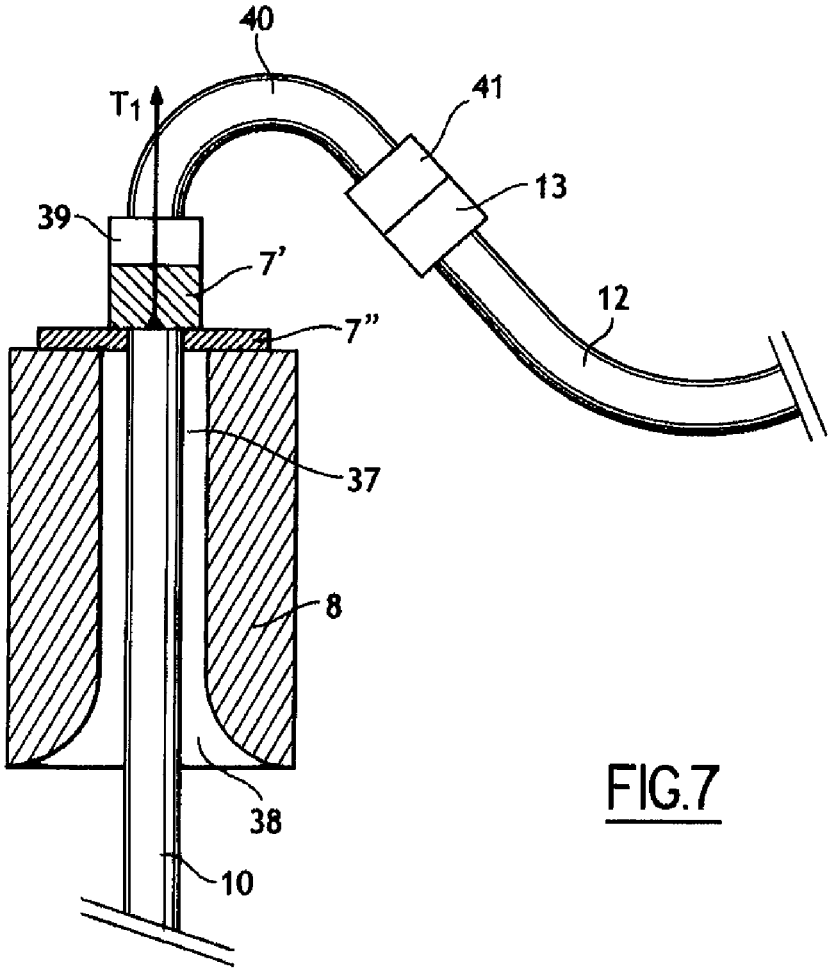
FIG. 7 is a partial schematic view of a first method of connection at the head of a riser.
Figure 8:
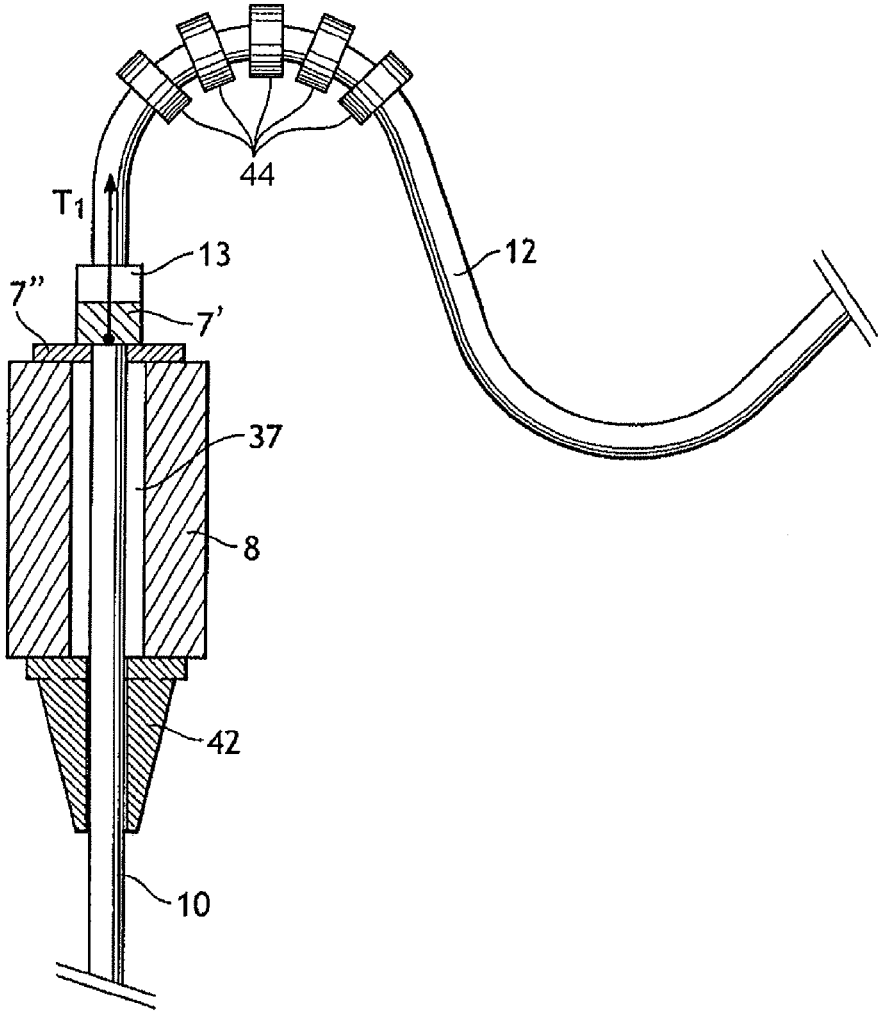
FIG. 8 is a partial schematic view of a second method of connection at the head of a riser.
Figure 9:
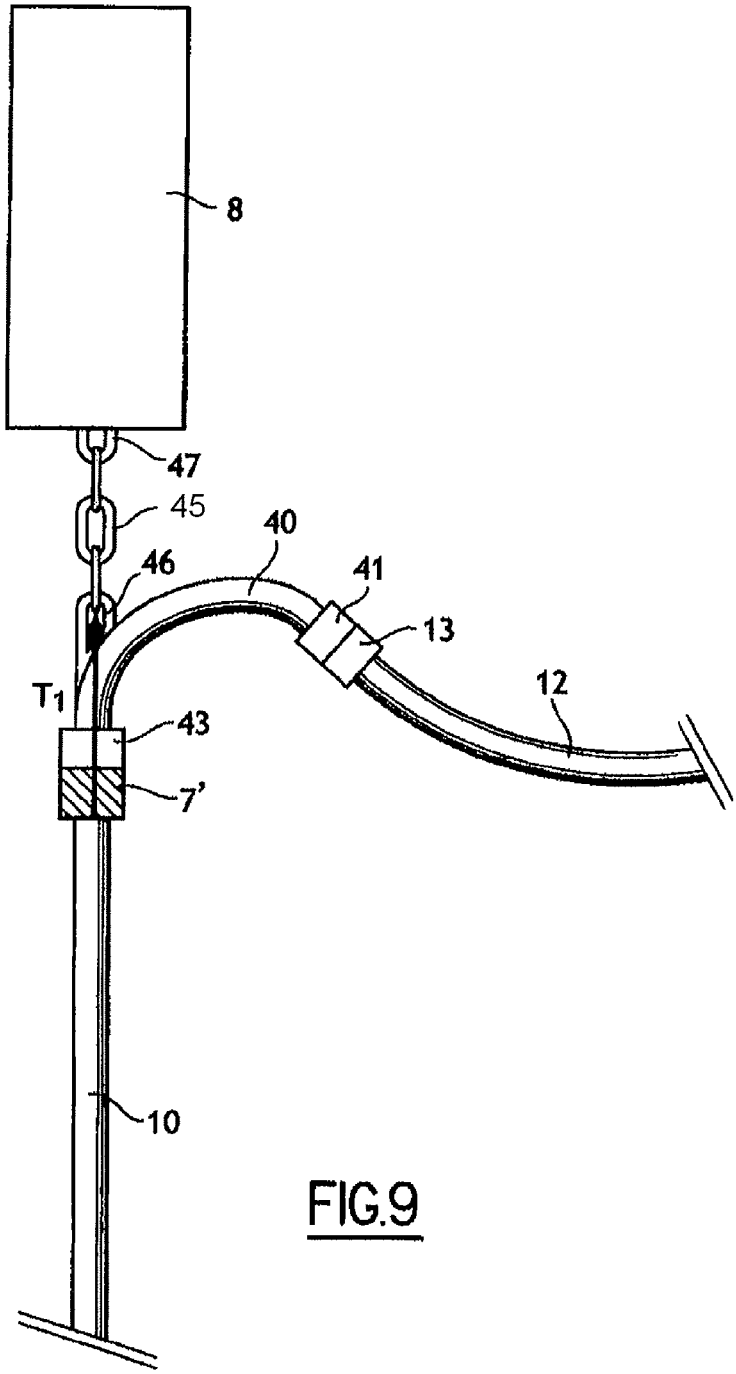
FIG. 9 is a partial schematic view of a third method of connection at the head of a riser.

FIGS. 7 to 9 depict various alternative forms of the head connection means. FIG. 7 shows that the flexible pipe 10 has an upper end fitting 7' to which there is connected the lower end fitting 39 of a gooseneck rigid pipe 40 the upper end fitting 41 of which is connected to the lower end fitting 13 of the head connecting flexible pipe 12 connected to the surface installation. The head connecting flexible pipe 12 is generally known by those skilled in the art as a "jumper". A two-part collar 7" acting as an end stop prevents the end fitting 7' from dropping down through the bore 37 in the buoy 8. The bore 37 at its lower part has a flared shape 38 acting as a bend restrictor in the event of any angular excursion of the pipe 10 with respect to the buoy. The buoy is advantageously an all-welded compartmentalized structure; air-filled watertight chambers can be ballasted and unballasted with water, so as to vary the buoyancy of the buoy.

In the alternative form depicted in FIG. 8, the gooseneck is dispensed with and is replaced by distributed-buoyancy means 44 (buoys surrounding the flexible "jumper" 12) which have the effect of giving the flexible "jumper" 12 the shape of an S. The end fitting 13 of the "jumper" 12 is therefore fixed directly to the end fitting 7' of the pipe 10. The lower flare 38 of the bore of the buoy 8 has also been replaced by a bend limiter 42 added at the lower part of the buoy.

In the alternative form depicted in FIG. 9, the buoy 8 is attached above the riser, by means of a chain 45 (or equivalent) fixed to the buoy in a ring 47 and to the gooseneck 40 in a ring 46.

One method of installing the installation according to the invention will now be described with reference to FIGS. 10 to 17. This method uses two ships, a flexible pipe laying ship 50 and a support ship 60.

The ship 50 comprises a reel 52 or a basket storing the flexible pipe that is to be laid in coiled form (or more precisely part of the pipe to be coiled) so that the flexible pipe 10 can be uncoiled by passing it over a turn pulley 54 and then over drive means 56, advantageously of the vertical quad-track caterpillar type situated above the central well 51 of the ship. A winch 53 equipped with an ancillary cable 66 will be described later on (cf. FIGS. 14 to 16) for the end of laying.

The ship 60 comprises a main crane 62 with the ability to lift the buoy 8 by virtue of a cable 63, and an ancillary hauling means 64, of the crane or winch type.

Figure 10:
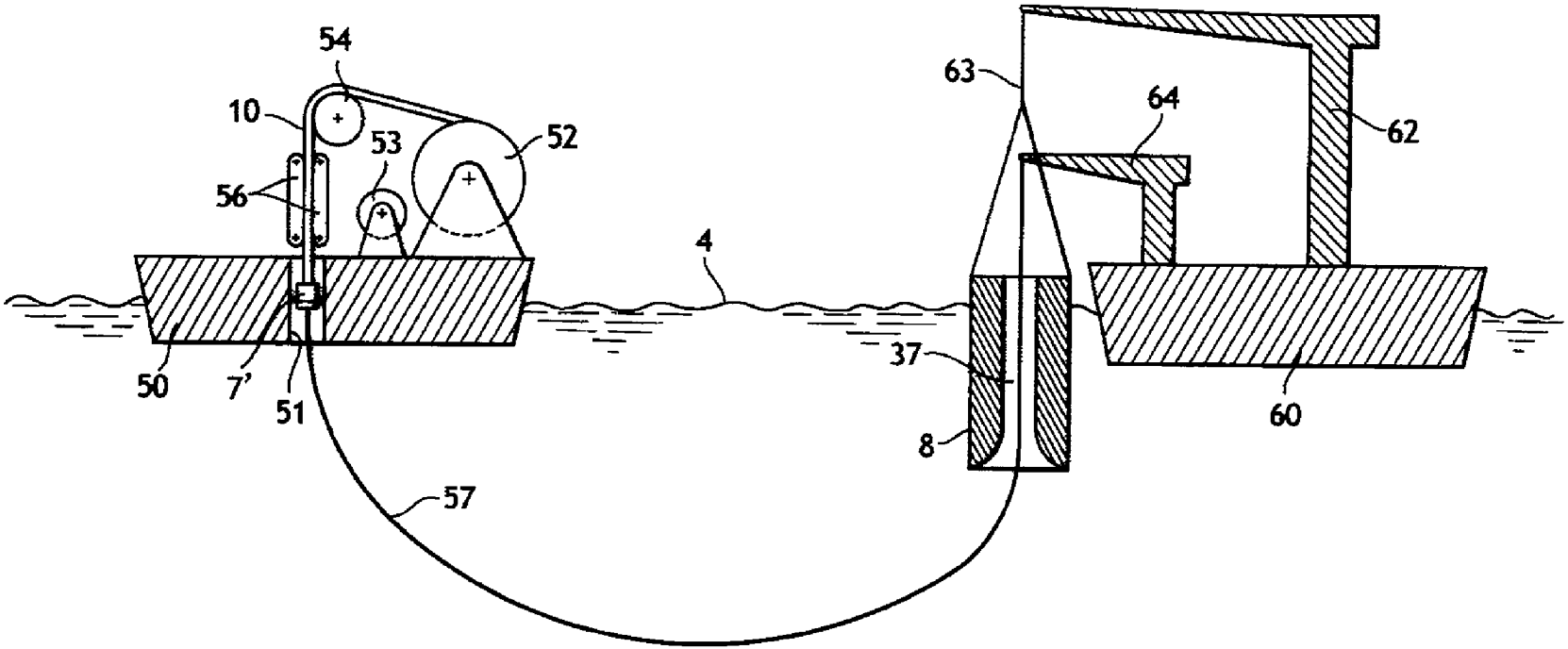
FIGS. 10 to 17 are schematic views in elevation of various steps in a method of installing the riser at sea.

In the first step depicted in FIG. 10, a cable 57 intended to pull the pipe 10 into the buoy 8 is attached first of all to the upper end fitting 7' of the pipe 10 and is pulled through the buoy 8 as far as the winch or crane 64.

Figure 11:
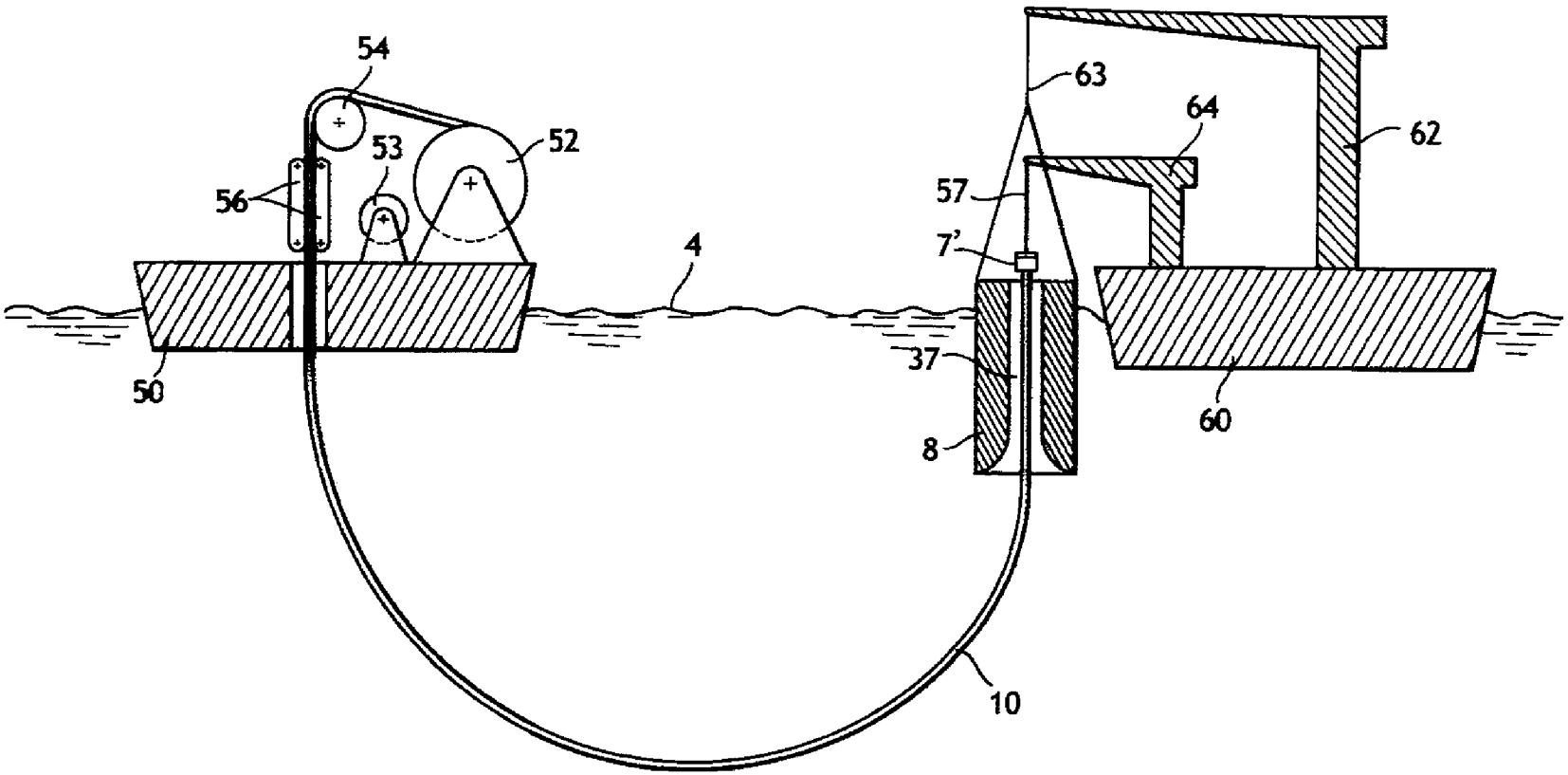

In the second step depicted in FIG. 11, the winch 64 is used to pull the pipe 10 into the buoy 8; at the same time the laying ship pays out the necessary length of flexible pipe 10.

Figure 12:
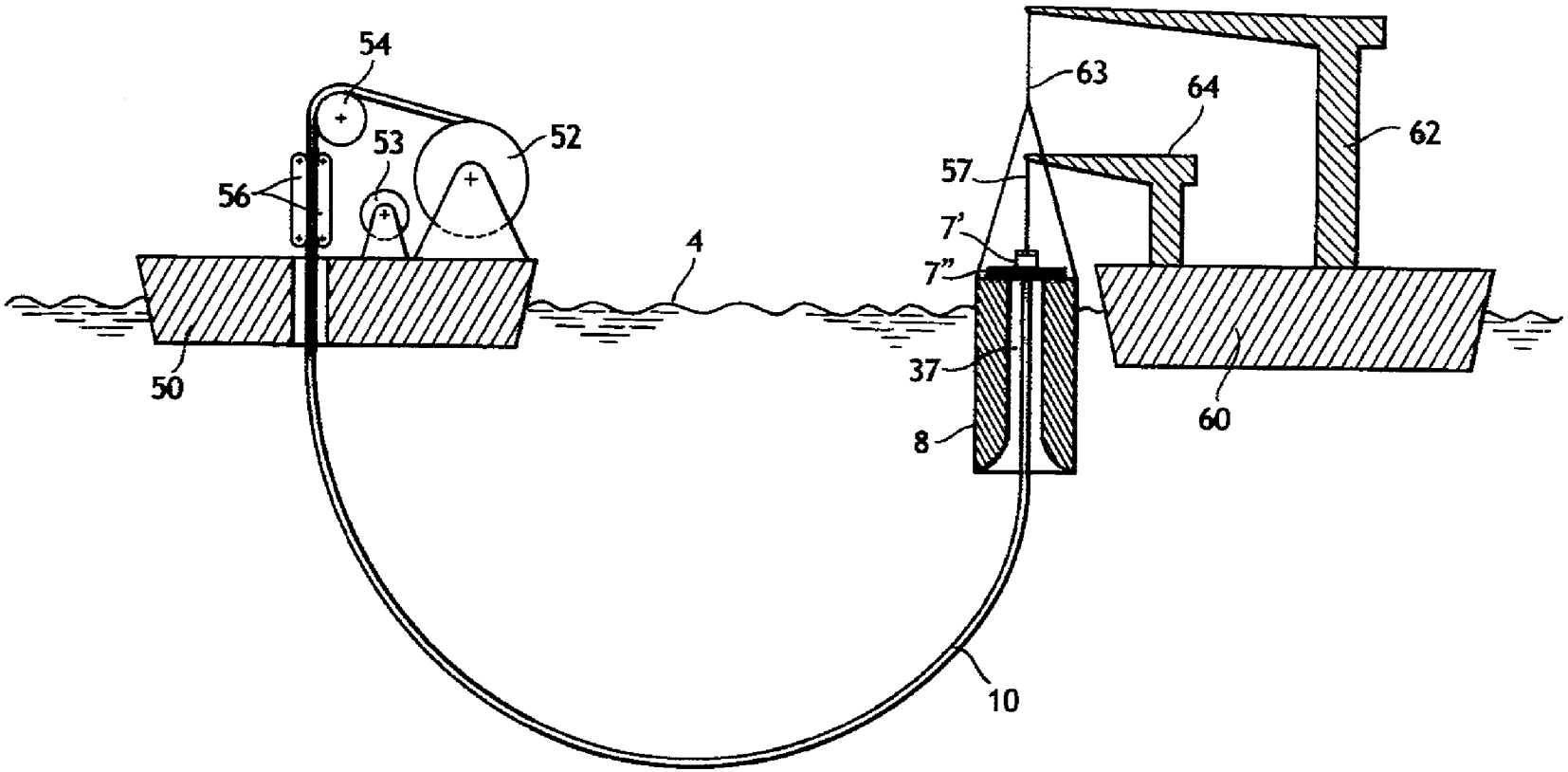

In the third step depicted in FIG. 12, the end fitting 7' (which is passed through the bore 37 in the buoy 8) is secured to the buoy using a two-part collar 7".

Figure 13:
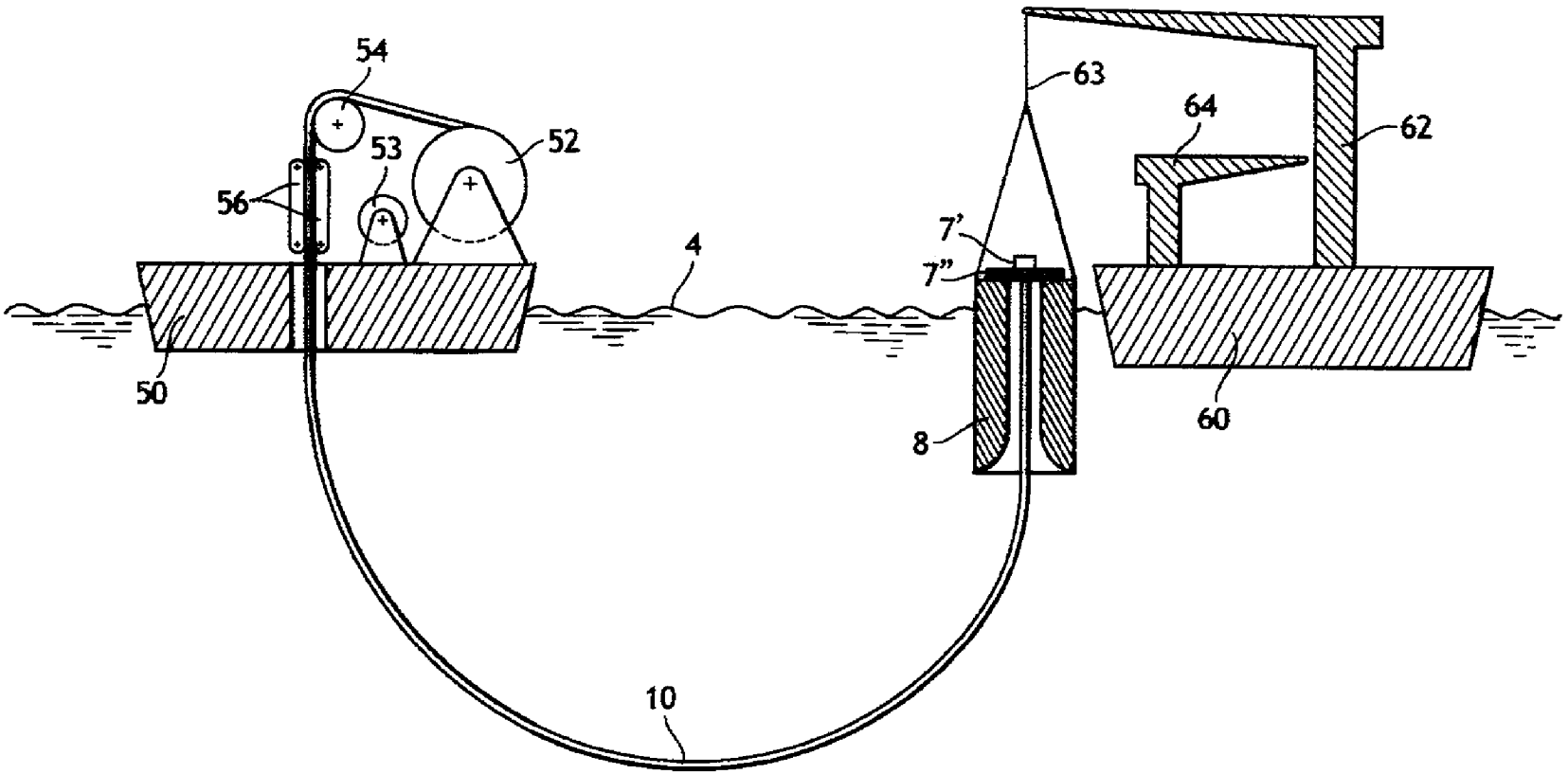

In the fourth step depicted in FIG. 13, the winch 64 and its cable set 57 are disconnected from the end fitting 7'.

It would not constitute a departure from the scope of the present invention if, during these four steps, the winch 64 used as an ancillary hauling means was fixed not to the ship 60 but rather to the upper part of the buoy 8. In such a case, at the end of the fourth step, the winch 64 would advantageously be detached from the buoy 8 so that it can be recovered and loaded onto the ship 60.

The flexible pipe 10 is then completely paid out from the laying ship 50, followed by the flexible pipe 30 which is attached to it by the end fittings 6', 31, followed by the rigid gooseneck 34 attached via the end fittings 32, 35.

Figure 14:
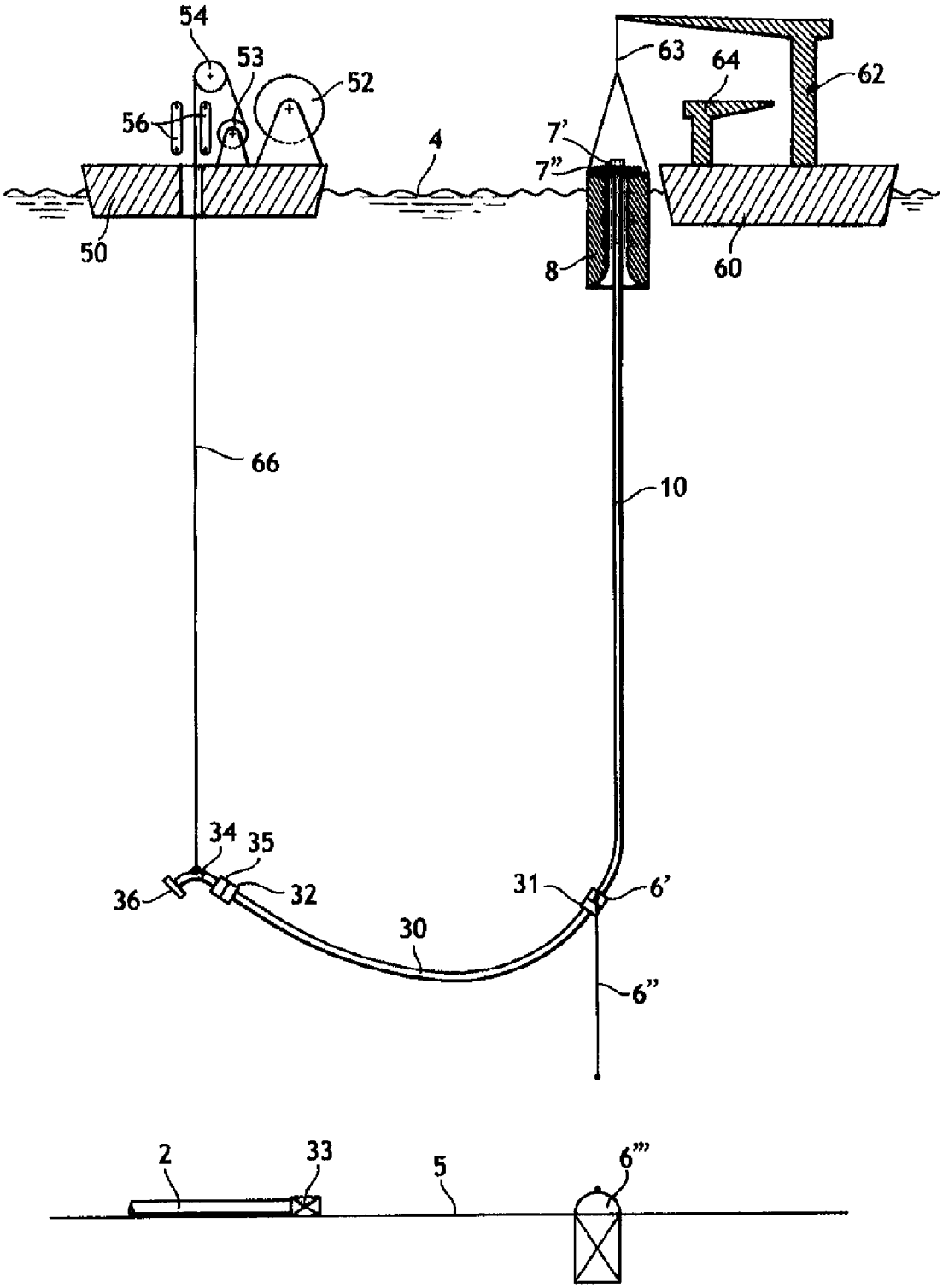

In the fifth step depicted in FIG. 14, a cable 66 is attached to the gooseneck 34, to complete the lowering by paying out the cable 66 which is unwound from the winch 53 passing over a turn pulley, for example the pulley 54 already used for turning the flexible pipe.

Figure 15:
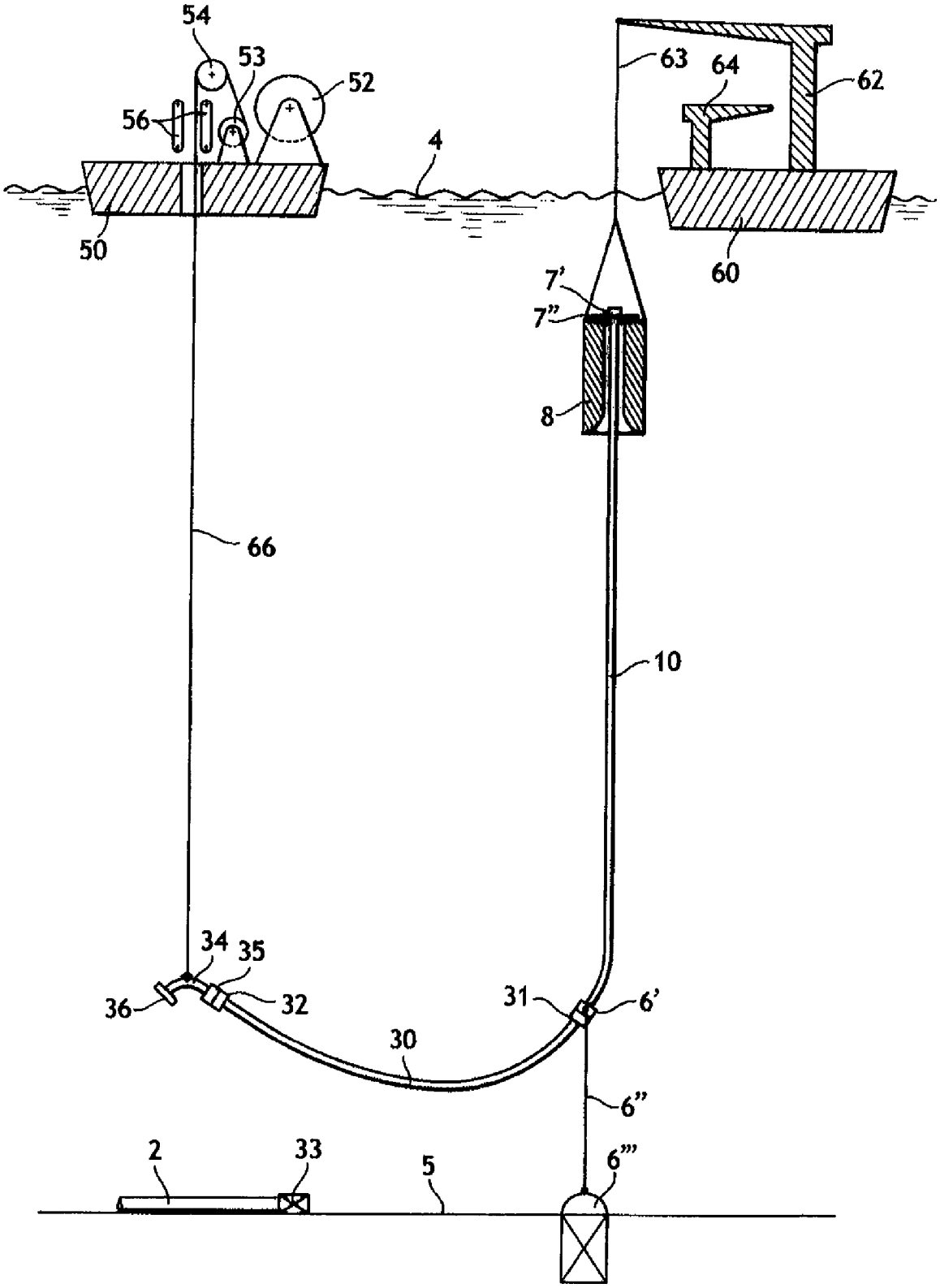

In the sixth step depicted in FIG. 15, the buoy 8 is lowered using the crane 62, the buoy being ballasted. The anchor cable 6" is then connected to the pre-installed anchor point 6'" with the assistance of an underwater robot (of the type known by the name of an "ROV").

Figure 16:
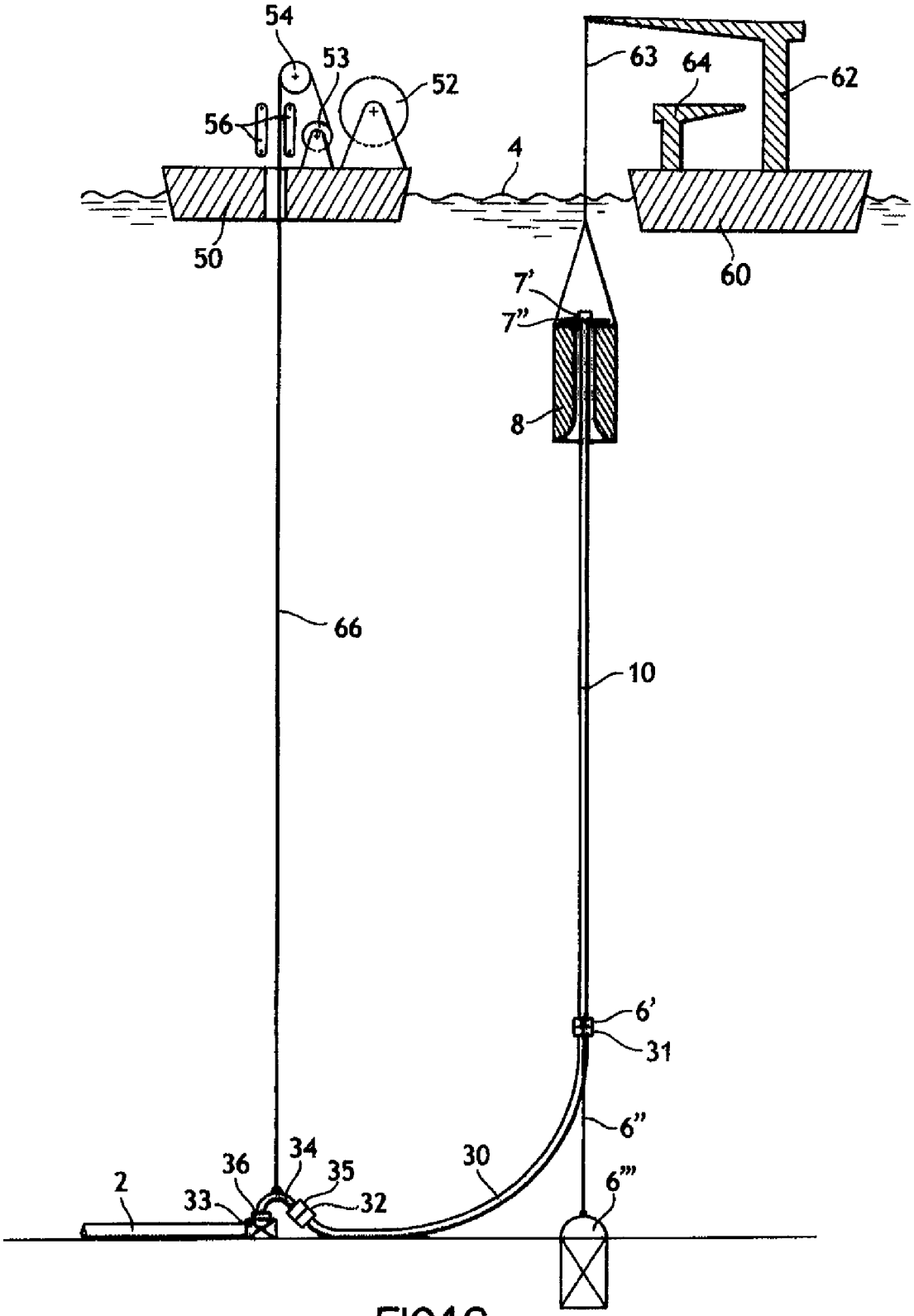

In the seventh step depicted in FIG. 16, the cable 66 continues to be lowered and the vertical connection is made between the gooseneck 34 and the end fitting 33 of the production pipe 2 using an automatic connector and with the assistance of an underwater robot.

Figure 17:
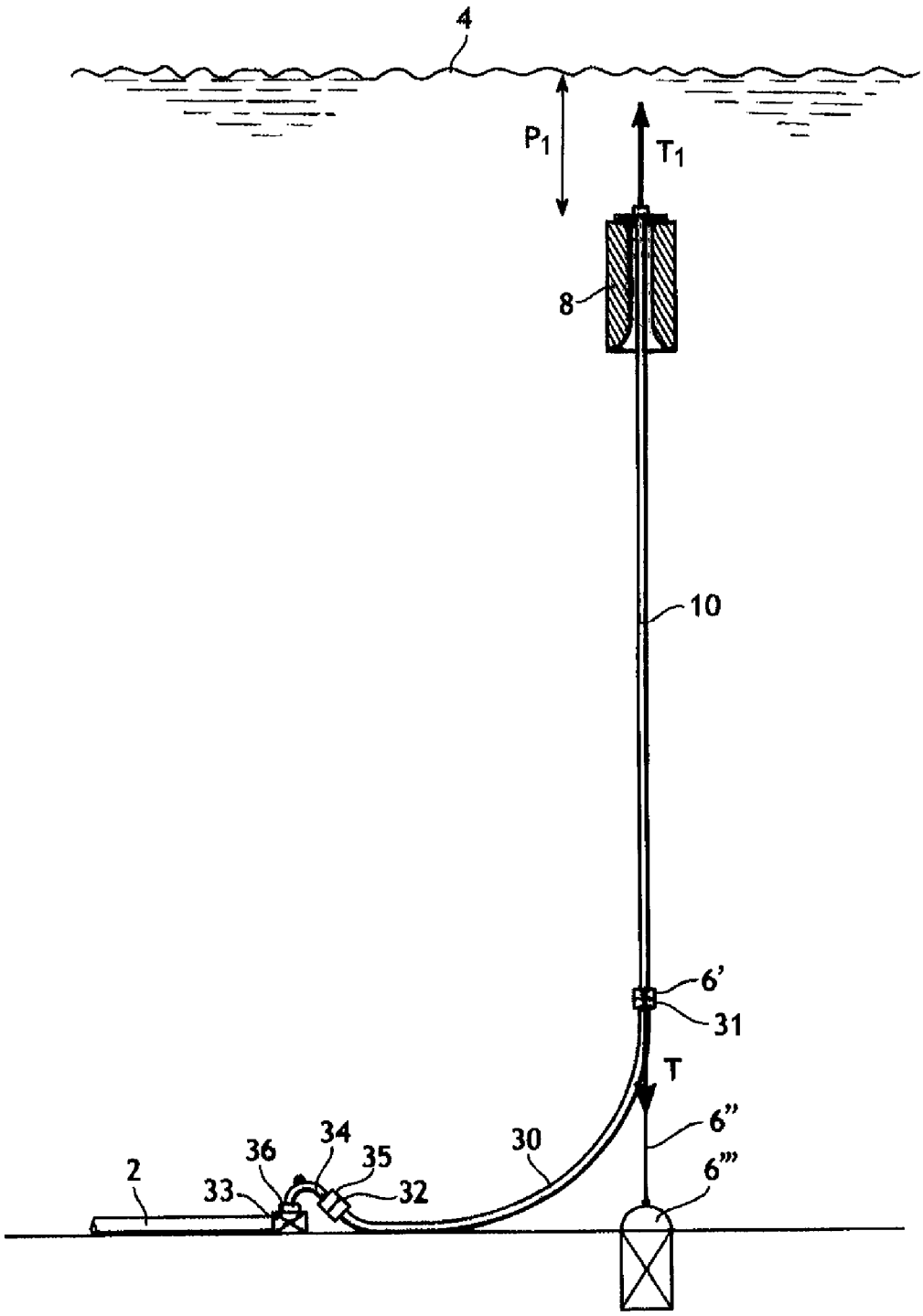

In the eighth and final step depicted in FIG. 17, the ballast is removed from the buoy 8 in order to obtain the tension T1 at the head of the column. This can be done from the support ship 60 using means of the type involving a flexible hose, a pump and an underwater robot. The installation is then complete and the vessels 50 and 60 can leave the area.

The column head fluidic connections can be made in a second phase, using methods known to those skilled in the art, once the surface installation 3 has been brought into position.

The method of installation that just been explained has several advantages.

Because the laying ship 50 supports only half the suspended weight of the pipe 10, the remainder being supported by the support ship 60, it is possible to use ships of lower capacity.

The laying tensions are lower by comparison with the laying of paid-out rigid pipe because flexible pipes are able to tolerate far lower curvatures than rigid pipes.

It is possible to lay the flexible pipe full of water, either completely or partially, so as to limit the reverse end cap effect during the laying operation during the period when the tension T has not yet been applied. What happens is that the water column inside the flexible pipe generates an internal pressure that opposes the external hydrostatic pressure and reduces the reverse end cap effect. It is thus possible, by adjusting the water level inside the flexible pipe, to reduce and control permanently the axial compressive stresses borne by the flexible pipe during the laying operation, so as to avoid damage to said pipe. Once the tension T has been applied, the riser can be emptied by pumping out the water that was used during the earlier phases of the installation, without any risk of damaging the flexible riser. It would not constitute a departure from the scope of the present invention if the water were replaced by another fluid, such as a hydrocarbon of the gas oil type. This solution would be particularly well suited to the laying of flexible pipes intended to convey gas, because the presence of water or moisture inside these pipes is liable subsequently to cause plugs of hydrates to form.

The laying of a flexible riser according to the present invention is far quicker than that of a rigid hybrid tower and the flexibility of the method allows for laying under sea conditions that are less favorable than those required for laying rigid hybrid towers.

The invention claimed is:

1. A riser installation using a flexible pipe of the unbonded type, wherein the pipe comprises, from inside outwards, at least one internal sealing sheath and two layers of tensile armor wires wound with a long pitch; the installation further comprises:

a head mechanical connection toward the sea surface, a submerged buoy at the head mechanical connection, a foot mechanical connection with the seabed, the pipe being arranged vertically between the head and the foot mechanical connections;

the head mechanical connection includes a connecting upper end fitting, the buoy has a central bore for passage of the pipe and a first diameter of the bore being greater than a second diameter of the connecting upper end fitting of the pipe;

fluidic connections at the head and at the foot mechanical connections to connect the riser respectively with surface equipment and with seabed equipment; and wherein the foot of the riser experiences a calculatable maximum reverse end-cap effect, at a depth of at least 1000 m and the buoy is configured to apply to the foot of the riser a reaction tension greater than at least 50% of the calculatable maximum reverse end-cap effect developed at the foot of the riser.

2. The installation as claimed in claim 1, wherein the buoy is configured to apply to the foot of the riser a reaction tension greater than at least 75% of the calculatable maximum reverse end-cap effect developed at the foot of the riser.

3. The installation as claimed in claim 1, wherein the buoy is configured to apply to the foot of the riser a reaction tension greater than at least 100% of the calculatable maximum reverse end-cap effect developed at the foot of the riser.

4. The installation as claimed in claim 1, wherein the internal sealing sheath is a polymer sheath.

5. The installation as claimed in claim 1, wherein the pipe further comprises a polymer external sealing sheath surrounding the layers of tensile armor wires.

6. The installation as claimed in claim 1, wherein the internal sealing sheath is configured such that the hydrostatic pressure is applied directly to the external face of the internal sealing sheath.

7. The installation as claimed in claim 1, wherein the pipe further comprises an internal pressure vault between the internal sealing sheath and the layers of tensile armor wires, the internal pressure vault comprising a short-pitch helical winding of wire configured to withstand the internal pressure of a fluid being conveyed in the pipe.

8. The installation as claimed in claim 1, wherein the layers of tensile armor wires comprise layers of wires based on carbon fiber.

9. The installation as claimed in claim 1, wherein the foot mechanical connection comprises at least one anchor cable configured and operable for tethering the bottom of the pipe to an anchor point fixed on the seabed.

10. The installation as claimed in claim 1, wherein the foot fluidic connection comprises a foot connection flexible pipe connecting the bottom of the riser to a production pipe.

11. The installation as claimed in claim 10, wherein the foot fluidic connection comprises a connecting lower end fitting fixed at the bottom of the pipe, and at least one anchor cable having an upper end secured to the lower connecting end fitting.

12. The installation as claimed in claim 10, wherein the foot connecting flexible pipe has distributed buoyancy.

13. The installation as claimed in claim 1, wherein the head mechanical connection comprises a multi-part collar configured as an end stop between an upper part of the buoy and the connecting upper end fitting of the pipe.

14. The installation as claimed in claim 1, further comprising a bend limiter at a bottom of the bore through the buoy.

15. The installation as claimed in claim 1, wherein the head mechanical connection comprises a tension line connecting a bottom of the buoy to an element secured to the top of the pipe.

16. The installation as claimed in claim 15, wherein the element secured to the top of the pipe comprises a gooseneck which is used for the head fluidic connection.

17. A method of installing a riser installation having a flexible pipe of the unbonded type, wherein the pipe comprises, from the inside outwards, at least one internal sealing sheath and two layers of tensile armor wires wound with a long pitch:

the method comprising:

arranging the pipe vertically between a head mechanical connection at a submerged buoy and a foot mechanical connection with the seabed;

forming fluidic connections at the head and at the foot to connect the riser respectively with surface equipment and with seabed equipment;

positioning the foot of the riser at a depth of at least 1000 m where the riser experiences a calculatable maximum reverse end-cap effect;

causing the buoy to apply to the foot of the riser a reaction tension greater than at least 50% of the calculatable maximum reverse end-cap effect developed at the foot of the riser; and laying the installation by paying out the flexible pipe from a first vessel;

supporting the buoy on a second vessel capable of supporting the ballasted buoy between a raised position close to the sea surface and a lowered position, attaching a first end of the paid-out flexible pipe to the buoy in the raised position, paying out the flexible pipe such that it hangs between the first vessel and the second vessel; and extending a second end of the paid-out flexible pipe by a connecting hose fitting with a fluidic coupling, attaching the coupling to the first laying vessel, paying out an attachment line to lower the coupling substantially to the second end, lowering the coupling and the second end down near to the seabed, mechanically connecting the second end and fluidically connecting the coupling, and then removing ballast from the buoy.

18. The method as claimed in claim 17, further comprising filling the flexible pipe with water during pipe laying.

* * * * *